US009978489B2

(12) United States Patent
Takenaka et al.

(10) Patent No.: US 9,978,489 B2
(45) Date of Patent: May 22, 2018

(54) METHOD OF PRODUCING GRAIN ORIENTED ELECTRICAL STEEL SHEET

(71) Applicant: JFE STEEL CORPORATION, Tokyo (JP)

(72) Inventors: Masanori Takenaka, Tokyo (JP); Takeshi Imamura, Tokyo (JP); Yasuyuki Hayakawa, Tokyo (JP); Yukihiro Shingaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 295 days.

(21) Appl. No.: 14/915,708

(22) PCT Filed: Sep. 25, 2014

(86) PCT No.: PCT/JP2014/004921
§ 371 (c)(1),
(2) Date: Mar. 1, 2016

(87) PCT Pub. No.: WO2015/045397
PCT Pub. Date: Apr. 2, 2015

(65) Prior Publication Data

US 2016/0196909 A1 Jul. 7, 2016

(30) Foreign Application Priority Data

Sep. 26, 2013 (JP) ..... 2013-199683

(51) Int. Cl.
*C21D 8/12* (2006.01)
*C21D 8/02* (2006.01)
(Continued)

(52) U.S. Cl.
CPC ..... *H01F 1/16* (2013.01); *C21D 1/34* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS 4,824,493 A 4/1989 Yoshitomi et al.
4,979,996 A 12/1990 Kobayashi et al.
(Continued)

FOREIGN PATENT DOCUMENTS

CN 102471818 A 5/2012
CN 103097563 A 5/2013
(Continued)

OTHER PUBLICATIONS

Aug. 22, 2016 Extended Search Report issued in European Patent Application 14848446.2.
(Continued)

*Primary Examiner* — Deborah Yee
(74) *Attorney, Agent, or Firm* — Oliff PLC

(57) ABSTRACT

Provides is a method of producing a grain oriented electrical steel sheet by heating a steel slab having a predetermined composition, then subjecting the slab to hot rolling to obtain a hot rolled sheet, then optionally subjecting the hot rolled sheet to hot band annealing and subsequent cold rolling once, or twice or more with intermediate annealing performed therebetween to obtain a cold rolled sheet with final sheet thickness, then subjecting the cold rolled sheet to primary recrystallization annealing and subsequent secondary recrystallization annealing, in which the aging index AI of the steel sheet before final cold rolling is set to 70 MPa or less to effectively grow Goss-oriented grains to thereby obtain a grain-oriented electrical steel sheet with good magnetic properties, without the restriction of containing a relatively large amount of C.

10 Claims, 4 Drawing Sheets

(51) Int. Cl.

| | |
|---|---|
| ***C21D 9/46*** | (2006.01) |
| ***H01F 1/16*** | (2006.01) |
| ***C22C 38/00*** | (2006.01) |
| ***C22C 38/02*** | (2006.01) |
| ***C22C 38/60*** | (2006.01) |
| ***C21D 1/34*** | (2006.01) |
| ***C21D 6/00*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/34*** | (2006.01) |
| ***C22C 38/44*** | (2006.01) |
| ***C22C 38/46*** | (2006.01) |
| ***C23C 8/26*** | (2006.01) |

(52) U.S. Cl.

CPC ..... *C21D 6/008* (2013.01); *C21D 8/0205* (2013.01); *C21D 8/0226* (2013.01); *C21D 8/0236* (2013.01); *C21D 8/0263* (2013.01); *C21D 8/0273* (2013.01); *C21D 8/1261* (2013.01); *C21D 8/1272* (2013.01); *C21D 9/46* (2013.01); *C22C 38/00* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/34* (2013.01); *C22C 38/44* (2013.01); *C22C 38/46* (2013.01); *C22C 38/60* (2013.01); *C23C 8/26* (2013.01); *C21D 8/1222* (2013.01); *C21D 8/1233* (2013.01); *C21D 2201/05* (2013.01)

(56) References Cited

U.S. PATENT DOCUMENTS

| | | | |
|---|---|---|---|
| 5,244,511 | A | 9/1993 | Komatsubara et al. |
| 5,354,389 | A | 10/1994 | Arai et al. |
| 5,489,342 | A | 2/1996 | Arai et al. |
| 6,273,964 | B1 | 8/2001 | Fortunati et al. |
| 2011/0209798 | A1 | 9/2011 | Natori et al. |
| 2012/0018049 | A1 | 1/2012 | Fortunati et al. |
| 2012/0103474 | A1 | 5/2012 | Ushigami et al. |
| 2013/0160901 | A1 | 6/2013 | Omura et al. |

FOREIGN PATENT DOCUMENTS

| | | | |
|---|---|---|---|
| JP | S40-15644 | B | 7/1965 |
| JP | S51-13469 | B | 4/1976 |
| JP | S57-114614 | A | 7/1982 |
| JP | H02-196403 | A | 8/1990 |
| JP | H05-112827 | A | 5/1993 |
| JP | H05-186831 | A | 7/1993 |
| JP | H06-346147 | A | 12/1994 |
| JP | H11-350032 | A | 12/1999 |
| JP | 2001-060505 | A | 3/2001 |
| JP | 2001-303214 | A | 10/2001 |
| JP | 2002-363646 | A | 12/2002 |
| JP | 2003-171718 | A | 6/2003 |

OTHER PUBLICATIONS

Omura et al., "Influence of Primary-Recrystallization Texture on Selective Growth of Gross Grains," Materials Transactions, 2013, vol. 54, No. 1, pp. 14-21.

Dec. 22, 2014 International Search Report issued in International Patent Application No. PCT/JP2014/004921.

Dec. 1, 2016 Office Action issued in Chinese Patent Application No. 201480052914.0.

METHOD OF PRODUCING GRAIN ORIENTED ELECTRICAL STEEL SHEET

TECHNICAL FIELD

The disclosure relates to a method of producing a so-called grain oriented electrical steel sheet having crystal grains with the {110} plane in accord with the sheet plane and the <001> orientation in accord with the rolling direction, in Miller indices. Grain oriented electrical steel sheets, which are soft magnetic materials, are mainly used as iron cores of electric appliances, such as transformers.

BACKGROUND

It is known that grain oriented electrical steel sheets having crystal grains in accord with the {110}<001> orientation (hereinafter "Goss orientation") through secondary recrystallization annealing exhibit excellent magnetic properties (see, e.g. JPS40-15644B (PTL1)).

As indices of magnetic properties, the magnetic flux density $B_8$ at a magnetic field strength of 800 A/m and the iron loss $W_{17/50}$ per kg of the steel sheet when it is magnetized to 1.7 T in an alternating magnetic field at an excitation frequency of 50 Hz, are mainly used.

One means for reducing iron loss in grain oriented electrical steel sheets is to highly accord crystal grains after secondary recrystallization annealing with the Goss orientation. In order to increase the degree to which grains are accorded with the Goss orientation after secondary recrystallization annealing, it is important to induce differences of grain boundary mobility so that only highly Goss-orientated grains preferentially grow. In detail, it is important to form a predetermined microstructure in the texture of the primary recrystallized sheet, and to use precipitates called inhibitors to suppress growth of recrystallized grains other than Goss-oriented grains.

Known examples of predetermined primary recrystallized microstructures which allow only highly Goss-orientated grains to preferentially grow include {554}<225> oriented grains and {12 4 1}<014> oriented grains. By highly according these grains in a well balanced manner in the matrix of the primary recrystallized sheet, Goss-oriented grains may be highly accorded after secondary recrystallization annealing.

For example, JP2001-60505A (PTL2) discloses that a steel sheet subjected to secondary recrystallization annealing that stably exhibits excellent magnetic properties can be obtained when the steel sheet subjected to primary recrystallization annealing possesses: a texture in the vicinity of a surface layer of the steel sheet, having a maximum orientation within 10° from either the orientation of ($\phi_1$=0°, $\Phi$=15°, and $\phi_2$=0°) or the orientation of ($\phi_1$=5°, $\Phi$=20°, and $\phi_2$=70°) in Bunge's Eulerian angle representation; and a texture of a center layer of the steel sheet, having a maximum orientation within 5° from the orientation of ($\phi_1$=90°, $\Phi$=60°, and $\phi_2$=45°) in Bunge's Eulerian angle representation.

As techniques of using an inhibitor, for example, PTL1 discloses a method of using AlN and MnS, JPS51-13469B (PTL3) discloses a method of using MnS and MnSe, and both methods have been put into practical use.

These methods using an inhibitor ideally require a uniform and fine precipitate distribution of the inhibitor, and in order to achieve such state, it is necessary for the slab heating before hot rolling to be performed at a high temperature of 1300° C. or higher. However, as such high temperature slab heating is performed, the crystal structure of the slab becomes excessively coarse. The orientation of the slab structure is mostly a {100}<011> orientation which is a stable orientation of hot rolling, and such coarsening of the slab structure greatly impedes secondary recrystallization, and causes a significant deterioration of magnetic properties. Therefore, for grain-oriented electrical steel sheets obtained using an inhibitor and performing high temperature slab heating, it is necessary to contain C of around 0.03% to 0.08% in the material for the purpose of using the $\alpha$-$\gamma$ transformation during hot rolling to break the coarse slab structure. Nevertheless, if C remains in the product steel sheet, the magnetic properties of the product steel sheet are significantly deteriorated. Therefore, it is also necessary to perform decarburization annealing in any step after hot rolling to reduce the C content in the product steel sheet to around 0.003% or less.

As described above, in conventional methods of producing grain-oriented electrical steel sheets by using an inhibitor, high temperature slab heating requires a large energy, and a decarburization annealing step needs to be provided. Therefore, manufacturing costs are increased.

To address this issue, for example, JPH5-112827A (PTL4) discloses a so-called nitriding treatment technique in which magnetic properties equivalent to that achieved by high temperature slab heating can be achieved by performing low temperature slab heating. To achieve said purpose, the slab heating temperature is set to a low temperature of 1200° C. or lower, and in the slab heating stage, inhibitor forming elements such as Al, N, Mn, S are not completely dissolved in steel. After decarburization annealing, annealing is performed in a strongly-reductive atmosphere such as a mixed atmosphere of $NH_3$ and $H_2$ while running the steel sheet, to form an inhibitor mainly composed of (Al,Si)N.

Further, JPS57-114614A (PTL5) discloses a method of subjecting a silicon steel slab containing 0.02% or less of C to rough hot rolling at a starting temperature of 1250° C. or lower to obtain a hot rolled sheet, then subjecting the hot rolled sheet to recrystallization hot rolling in which the cumulative rolling reduction at 900° C. or higher is 80% or more and at least one pass applies a rolling reduction ratio of 35% or more, and then subjecting the hot rolled sheet to strain accumulating rolling in which the cumulative rolling reduction at 900° C. or lower is 40% or more, to break the slab structure even in steel with low C material.

However, in this method, although inhibitor elements such as Al and N are contained in steel, high temperature slab heating is not performed, and therefore, fine precipitation of the inhibitor does not occur. Further, since nitriding treatment such as mentioned above is not performed, the growth inhibiting effect of primary recrystallized grains is insufficient and magnetic properties deteriorate. In addition, cooling conditions before final cold rolling and after annealing are not specified, and contents of solute elements (C, N and the like) are not sufficiently controlled.

JPH6-346147A (PTL6) discloses a method of subjecting a silicon steel slab containing 0.0005% to 0.004% of C to rough hot rolling at a starting temperature range of 1000° C. to 1200° C. to obtain a hot rolled sheet, and then subjecting the hot rolled sheet to short time annealing in a temperature range of 700° C. to 1100° C. as necessary, and subsequent cold rolling once, or twice or more with intermediate annealing performed therebetween to obtain a cold rolled sheet, then heating the cold rolled sheet in a temperature range of 850° C. to 1050° C. for 1 second or more and 200 seconds or less, and then subjecting the steel sheet to nitriding treatment while running the steel sheet. However, as in the case with the method of PTL5, although inhibitor elements such as Al and N are contained in steel, high temperature slab heating is not performed, and therefore, fine precipitation of the inhibitor is insufficient. Accordingly, the growth inhibiting effect of primary recrystallized grains is insufficient and magnetic properties deteriorate. In addition, cooling conditions before final cold rolling and after annealing are not specified, and contents of solute elements (C, N and the like) are not sufficiently controlled.

CITATION LIST

Patent Literature

PTL 1: JPS40-15644B
PTL 2: JP2001-60505A
PTL 3: JPS51-13469B
PTL 4: JPH5-112827A
PTL 5: JPS57-114614A
PTL 6: JPH6-346147A

Non-Patent Literature

NPL 1: Materials Transactions, Vol. 54 No. 01 (2013) pp. 14-21

SUMMARY

Technical Problem

As mentioned above, a conventional primary recrystallized texture controlling technique such as that disclosed in PTL2 is a manufacturing technique where an inhibitor is used and high temperature slab heating (heating temperature: 1200° C. or higher) is performed. Therefore, this technique has a restriction in that it is necessary to contain C of around 0.03% to 0.08% in the material for the purpose of using α-γ transformation during hot rolling to break coarse slab structures, and the technique is merely a technique of specifying a favorable range within said restriction.

It could therefore be helpful to provide a method of producing a grain-oriented electrical steel sheet that enables obtaining good magnetic properties by effectively growing Goss-oriented grains and achieving high yield, low cost, and high productivity, without the restriction of containing a relatively large amount of C.

Solution to Problem

In order to solve the aforementioned problems, we have made intensive studies focusing on the amount of solute C in the steel sheet before final cold rolling.

As a result, we discovered that by minimizing the amount of solute C in the steel sheet before final cold rolling, magnetic properties of the product steel sheet are significantly improved.

Specifically, it was discovered that by limiting the C content of the slab to a range of 0.0005 mass % or more and 0.005 mass % or less, and the Si content of the slab to a range of 2.0 mass % or more and 4.5 mass % or less, and controlling the average cooling rate between 800° C. and 200° C. after the heating process right before final cold rolling to an appropriate range in relation with the contents of solute C and Si in the slab, the aging index AI of the steel sheet before final cold rolling of 70 MPa or less is achieved, allowing for an improvement of magnetic properties.

This disclosure is based on these findings.

Further, it was discovered that by adjusting the heating rate in primary recrystallization annealing to 10° C./s or higher and 100° C./s or lower, a ratio of {554}<225> intensity to random intensity of 12 or more and a ratio of {554}<225> intensity to {111}<110> intensity of 7 or more are achieved in the texture of the center layer in the sheet thickness direction of the steel sheet subjected to primary recrystallization annealing, allowing for a further improvement of magnetic properties.

The disclosure is based on the aforementioned discoveries. We thus provide the following.

1. A method of producing a grain oriented electrical steel sheet, the method comprising:

heating a steel slab having a composition containing by mass %

C: 0.0005% to 0.005%,
Si: 2.0% to 4.5%,
Mn: 0.005% to 0.3%,
S and/or Se (in total): 0.05% or less,
sol.Al: 0.010% to 0.04%,
N: 0.005% or less, and
the balance being Fe and incidental impurities;

then subjecting the slab to hot rolling to obtain a hot rolled sheet;

then optionally subjecting the hot rolled sheet to hot band annealing;

then subjecting the hot rolled sheet to cold rolling once, or twice or more with intermediate annealing performed therebetween to obtain a cold rolled sheet with final sheet thickness; and then subjecting the cold rolled sheet to primary recrystallization annealing;

then subjecting the cold rolled sheet to secondary recrystallization annealing, wherein a solute C content parameter X calculated from the following formula (1) is used, and an average cooling rate R (° C./s) between 800° C. and 200° C. after a heating process right before final cold rolling is set to or lower than an upper limit average cooling rate $R_H$ calculated from the following formula (2) to achieve an aging index AI of the steel sheet before the final cold rolling of 70 MPa or less, $$X=[\%\ Si]/28.09+100[\%\ C]/12.01 \quad (1)$$

$$R_H=10/X \quad (2)$$

where [% M] in formula (1) represents the content of element M (mass %).

2. The method of producing a grain oriented electrical steel sheet according to aspect 1, wherein an average heating rate between 500° C. and 700° C. in the primary recrystallization annealing is adjusted to 10° C./s or higher and 100° C./s or lower to achieve a ratio of {554}<225> intensity to random intensity of 12 or more and a ratio of {554}<225> intensity to {111}<110> intensity of 7 or more in a texture of a center layer in the sheet thickness direction of the steel sheet subjected to primary recrystallization annealing.

3. The method of producing a grain oriented electrical steel sheet according to aspect 1 or 2, wherein the steel slab further contains by mass % one or more elements selected from Ni: 0.005% to 1.5%, Sn: 0.005% to 0.50%, Sb: 0.005% to 0.50%, Cu: 0.005% to 1.5%, Cr: 0.005% to 0.10%, P: 0.005% to 0.50%, and Mo: 0.005% to 0.50%.

4. The method of producing a grain oriented electrical steel sheet according to any one of aspects 1 to 3, wherein the steel slab further contains by mass % one or more elements selected from Ti: 0.001% to 0.1%, Nb: 0.001% to 0.1%, and V: 0.001% to 0.1%.

5. The method of producing a grain oriented electrical steel sheet according to any one of aspects 1 to 4, wherein an additional inhibitor treatment is performed at any stage between the primary recrystallization annealing and the secondary recrystallization annealing.

6. The method of producing a grain oriented electrical steel sheet according to aspect 5, wherein nitriding treatment is performed, as the additional inhibitor treatment.

7. The method of producing a grain oriented electrical steel sheet according to aspect 5, wherein one or more elements selected from sulfide, sulfate, selenide, and selenate are added to an annealing separator applied to the steel sheet before the secondary recystallization annealing, as the additional inhibitor treatment.

8. The method of producing a grain oriented electrical steel sheet according to any one of aspects 1 to 7, wherein a magnetic domain refining treatment is performed at any stage after the final cold rolling.

9. The method of producing a grain oriented electrical steel sheet according to aspect 8, wherein the magnetic domain refining treatment is performed by applying electron beam irradiation to the steel sheet subjected to the secondary recrystallzation annealing.

10. The method of producing a grain oriented electrical steel sheet according to aspect 8, wherein the magnetic domain refining treatment is performed by applying laser irradiation to the steel sheet subjected to the secondary recrystallization annealing.

Advantageous Effect

With the disclosure, the texture of the primary recrystallized sheet can be controlled so that the crystal grains of the product steel sheet are highly in accord with the Goss orientation, and therefore it is possible to produce grain oriented electrical steel sheets having better magnetic properties after secondary recrystallization annealing compared to before. Specifically, even with a thin steel sheet with a thickness of 0.23 mm, in which increasing magnetic flux density is considered difficult, excellent magnetic properties i.e. magnetic flux density $B_8$ after secondary recrystallization annealing of 1.92 T or more can be obtained.

Further, by adjusting the average heating rate between 500° C. and 700° C. in primary recrystallization annealing to 10° C./s or higher and 100° C./s or lower, excellent magnetic properties i.e. magnetic flux density $B_8$ of 1.93 T or more can be obtained.

In addition, by performing additional inhibitor treatment, even better magnetic properties i.e. magnetic flux density $B_8$ of 1.94 T or more or even 1.95 T or more, can be obtained for each steel sheet.

Moreover, in either case, excellent iron loss properties i.e. iron loss $W_{17/50}$ after magnetic domain refining treatment of 0.70 W/kg or less, can be achieved.

Further, it is notable that by lowering the slab heating temperature, and in some cases, omitting decarburization annealing, and improving product yield by obtaining uniform structures in the length direction, width direction and thickness direction of the coil, it is possible to reduce costs.

In addition, due to the rolling load reduction resulting from the reduction in C content, ultra-thin material can be produced, and a further reduction in iron loss can be achieved without increasing costs.

DETAILED DESCRIPTION

Our methods and products will be described in detail below. Hereinbelow, reference will be made to the experiments by which the disclosure has been completed. Unless otherwise specified, the indication of "%" regarding the compositions of the steel sheet shall stand for "mass %". Slabs of three kinds of steel in which the balance is Fe and incidental impurities, namely steel A (C: 0.0037%, Si: 2.81%, Mn: 0.07%, S: 0.006%, Se: 0.006%, sol.Al: 0.014%, N: 0.0044%), steel B (C: 0.0019%, Si: 3.59%, Mn: 0.08%, S: 0.003%, Se: 0.009%, sol.Al: 0.028%, N: 0.0026%), and steel C (C: 0.0043%, Si: 3.85%, Mn: 0.05%, S: 0.002%, Se: 0.016%, sol.Al: 0.022%, N: 0.0030%) were heated to 1200° C. and then subjected to hot rolling to obtain hot rolled sheets with thickness of 2.4 mm. Then, the hot rolled sheets were subjected to hot band annealing at 1050° C. for 60 seconds, subsequently cooled between 800° C. and 200° C. at an average cooling rate of 20° C./s to 100° C./s, and then subjected to cold rolling to obtain cold rolled sheets with thickness of 0.23 mm which in turn were subjected to primary recrystallization annealing at 800° C. for 60 seconds. The heating rate between 500° C. and 700° C. in primary recrystallization annealing was 40° C./s.

Then, annealing separators, each mainly composed of MgO were applied to the steel sheet surfaces, and then the cold rolled sheets were subjected to secondary recrystallization annealing combined with purification annealing at 1200° C. for 50 hours. Subsequently, phosphate-based insulating tension coating was applied and baked on the steel sheets and flattening annealing was performed for the purpose of flattening the resulting strips to obtain products, and test pieces were obtained under respective conditions.

Figure 1:
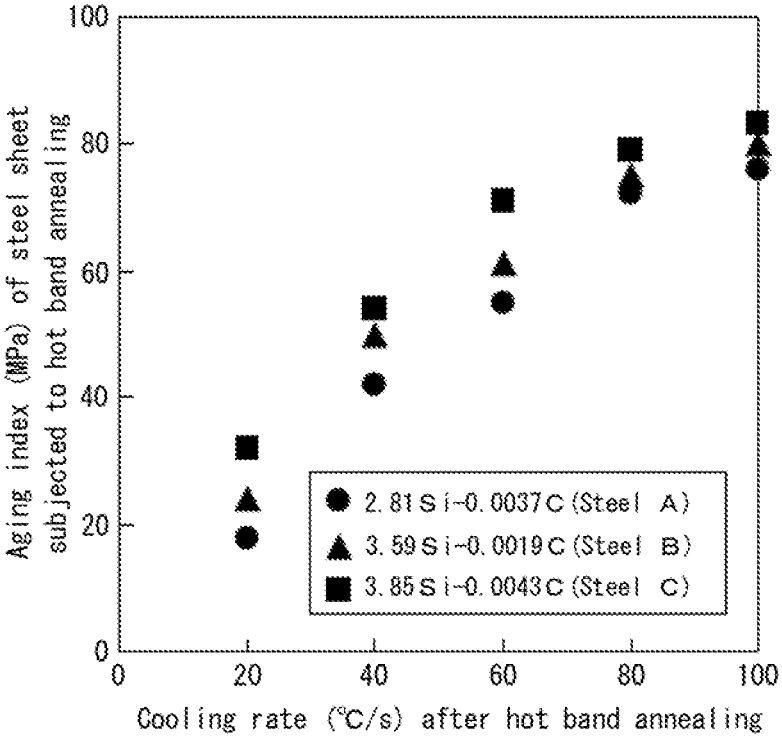
FIG. 1 is a graph showing the influence of the cooling rate after hot band annealing on the aging index AI of the steel sheets subjected to hot band annealing.

FIG. 1 shows the results of studying the influence of the cooling rate after hot band annealing on the aging index AI of the steel sheets subjected to hot band annealing (steel sheets after hot band annealing and before final cold rolling).

The aging index AI was obtained by cutting out No. 5 test pieces from samples of overall thickness of the steel sheets before final cold rolling in accordance with JIS Z 2241, and then applying prestrain to the test pieces until reaching nominal strain of 7.5% at an initial strain rate of $1\times10^{-3}$, and then subjecting the test pieces to aging treatment at 100° C. for 30 minutes, and then performing tensile tests at the initial strain rate of $1\times10^{-3}$, and then subtracting the tensile stress at the time of applying prestrain strain of 7.5% from the yield stress (lower yield point if an yielding phenomenon occurs) at the time of the tensile tests after aging treatment.

Here, X shown in the following formula (1) was set as the solute C content parameter, and using X, the upper limit values $R_H$ of the average cooling rates between 800° C. and 200° C. of each steel sheet after hot band annealing was set as shown in the following formula (2). The upper limit average cooling rates $R_H$ between 800° C. and 200° C. after hot band annealing which are calculated from the steel compositions of steels A, B, and C are 76° C./s, 70° C./s, and 58° C./s respectively.

$$X=[\%\ Si]/28.09+100[\%\ C]/12.01 \quad (1)$$

$$R_H=10/X \quad (2)$$

It can be seen from FIG. 1 that as the solute C content parameter X is reduced, the aging index AI is reduced. Further, in cases where the average cooling rate R between 800° C. and 200° C. after hot band annealing satisfied $R\leq R_H$, the aging index AI was 70 MPa or less.

Figure 2:
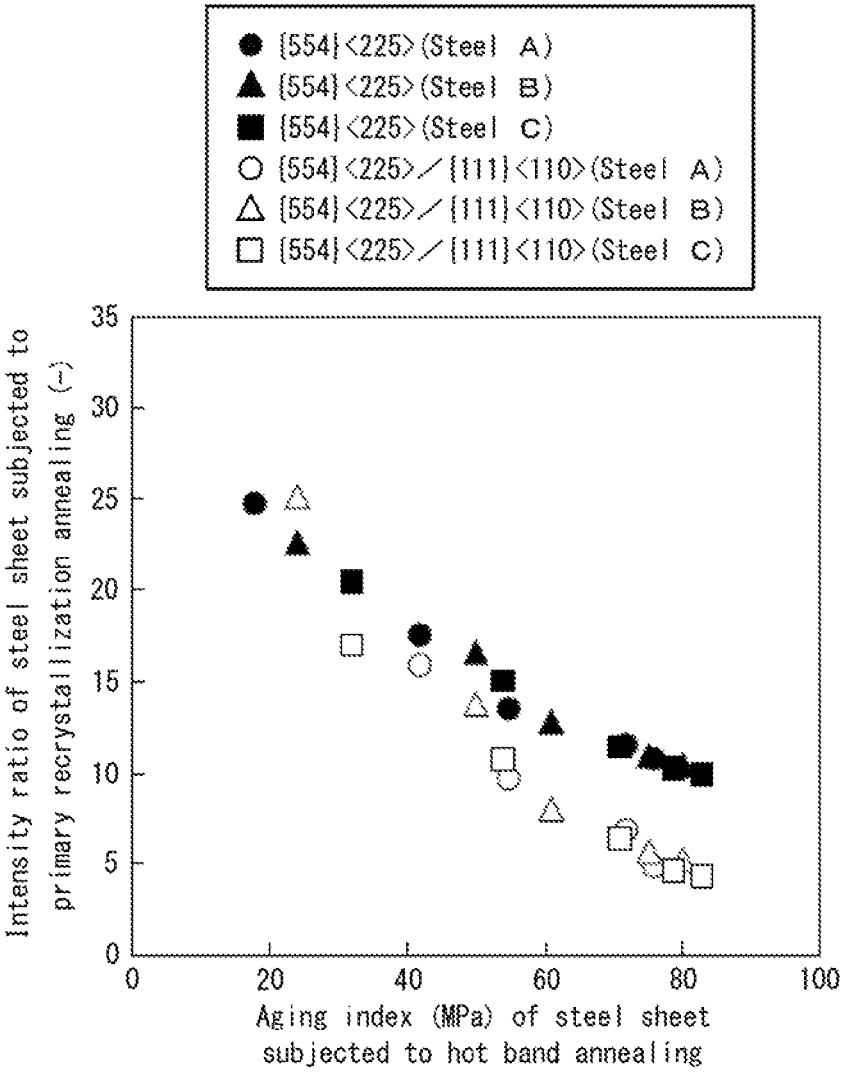
FIG. 2 is a graph showing the influence of the aging index AI of the steel sheets subjected to hot band annealing on the ratio of {554}<225> intensity to random intensity and the ratio of {554}<225> intensity to {111}<110> intensity of the center layer in the sheet thickness direction of the steel sheets subjected to primary recrystallization annealing.

Next, FIG. 2 shows the results of studying the influence of the aging index AI of the steel sheets subjected to hot band annealing on the ratio of {554}<225> intensity to random intensity and the ratio of {554}<225> intensity to {111}<110> intensity of the center layer in the sheet thickness direction of the steel sheets subjected to primary recrystallization annealing. Regarding crystal orientations of the steel sheets subjected to primary recrystallization annealing, samples ground and thinned until reaching the center layer in the thickness direction were etched for 30 seconds using a 10% nitric acid, the (110) planes, (200) planes, and (211) planes were measured with the X-ray Schulz method, and ODF (Orientation Distribution Function) analysis was performed using the data obtained to calculate the intensity of each crystal orientation. For the analysis, Textools, a software produced by ResMat Corporation was used, and calculation was made by the ADC (Arbitrarily Defined Cell) method. The ratio of {554}<225> intensity to random intensity was set to be $(\phi_1, \Phi, \phi_2)=(90, 60, 45)$, and the ratio of {111}<110> intensity to random intensity was set to be $(\phi_1, \Phi, \phi_2)=(60, 55, 45)$ in Bunge's Eulerian angle.

It can be seen from FIG. 2 that as the aging index AI of the steel sheets subjected to hot band annealing is reduced, the ratio of {554}<225> intensity to random intensity as well as the ratio of {554}<225> intensity to {111}<110> intensity of the center layer in the sheet thickness direction of the steel sheets subjected to primary recrystallization annealing is increased.

Figure 3:
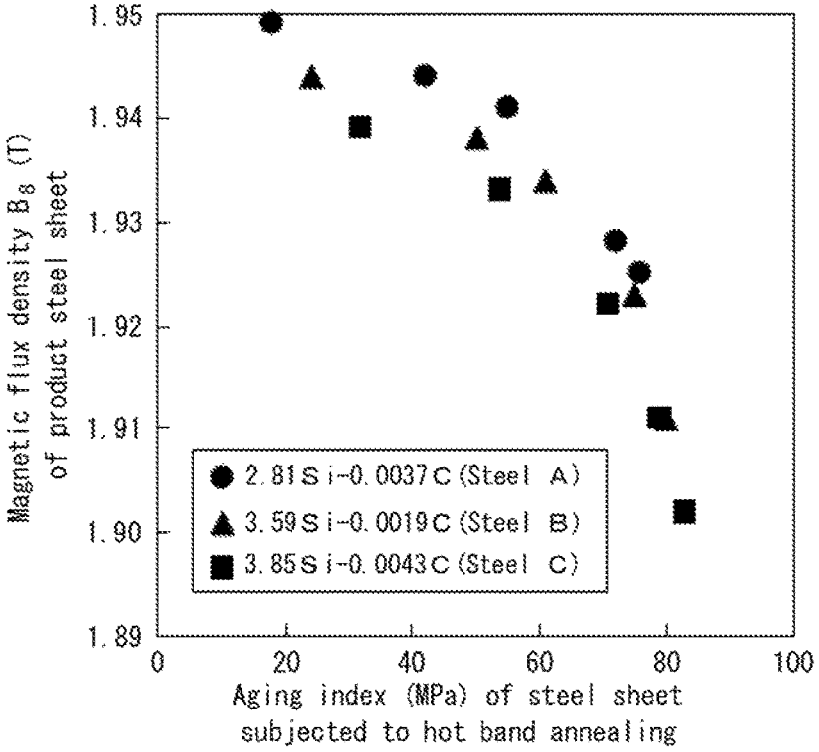
FIG. 3 is a graph showing the influence of the aging index AI of the steel sheets subjected to hot band annealing on the magnetic flux density $B_8$ of the product steel sheets.

Next, FIG. 3 shows the results of studying the influence of the aging index AI of the steel sheets subjected to hot band annealing on the magnetic flux density $B_8$ of the product steel sheets.

It can be seen from FIG. 3 that as the aging index AI of the steel sheets subjected to hot band annealing is reduced, the magnetic flux density is improved. Specifically, by controlling AI to be 70 MPa or less, a magnetic flux density $B_8$ of 1.93 T or more was achieved.

Further, the influence of the heating rate in primary recrystallization annealing was closely examined.

Various slabs containing C: 0.0035%, Si: 3.18%, Mn: 0.06%, sol.Al: 0.025%, N: 0.0022%, S: 0.003%, and Se: 0.015%, with the balance being Fe and incidental impurities were heated to 1240° C. and then subjected to hot rolling to obtain hot rolled sheets with thickness of 2.5 mm. Then, the hot rolled sheets were subjected to hot band annealing at 1000° C. for 60 seconds, and then cooled between 800° C. and 200° C. at an average cooling rate of 30° C./s. Here, when satisfying the relation of X=[% Si]/28.09+100[% C]/12.01, the upper limit average cooling rate $R_H$ (=10/X) between 800° C. and 200° C. after hot band annealing calculated from steel compositions is 70° C./s. The hot rolled sheets were then subjected to cold rolling to obtain cold rolled sheets with thickness of 0.23 mm which in turn were subjected to primary recrystallization annealing at 800° C. for 20 seconds. The heating rates between 500° C. and 700° C. in primary recrystallization annealing were varied in a range of 10° C./s to 300° C./s.

Then, annealing separators, each mainly composed of MgO were applied to the steel sheet surfaces, and then the cold rolled sheets were subjected to secondary recrystallization annealing combined with purification annealing at 1200° C. for 50 hours. Subsequently, phosphate-based insulating tension coating was applied and baked on the steel sheets and flattening annealing was performed for the purpose of flattening the resulting strips to obtain products, and test pieces were obtained under respective conditions.

Figure 4:
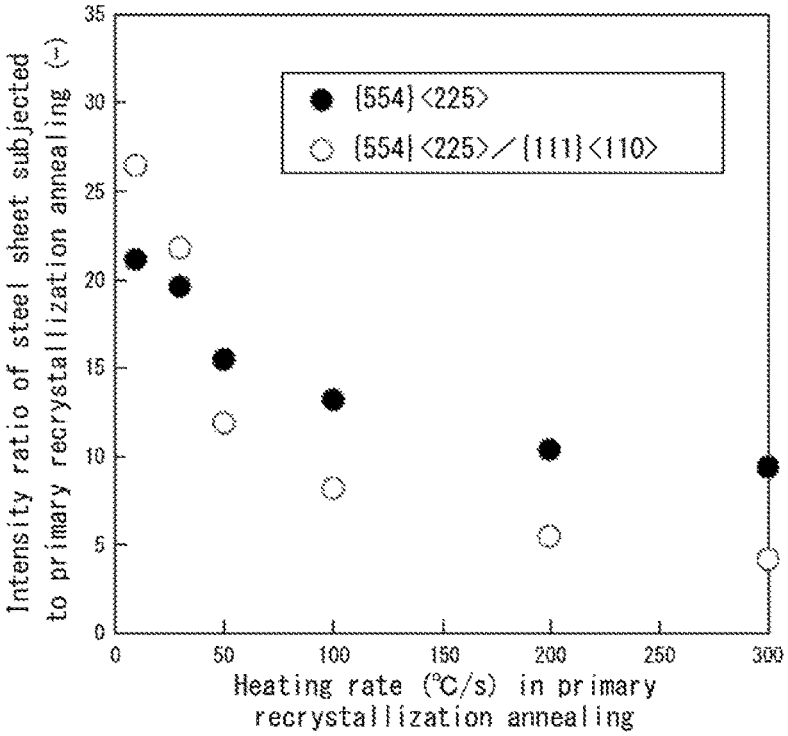
FIG. 4 is a graph showing the influence of heating rate between 500° C. and 700° C. in primary recrystallization annealing on the ratio of {554}<225> intensity to random intensity and the ratio of {554}<225> intensity to {111}<110> intensity of the center layer in the sheet thickness direction of the steel sheets subjected to primary recrystallization annealing.

FIG. 4 shows the results of studying the influence of the heating rate between 500° C. and 700° C. in primary recrystallization annealing on the ratio of {554}<225> intensity to random intensity and the ratio of {554}<225> intensity to {111}<110> intensity of the center layer in the sheet thickness direction of the steel sheets subjected to primary recrystallization annealing.

It can be seen from FIG. 4 that as the heating rate between 500° C. and 700° C. in primary recrystallization annealing is reduced, the ratio of {554}<225> intensity to random intensity as well as the ratio of {554}<225> intensity to {111}<110> intensity of the center layer in the sheet thickness direction of the steel sheets subjected to primary recrystallization annealing are increased. Further, when the heating rate in primary recrystallization annealing is 100° C./s or lower, a ratio of {554}<225> intensity to random intensity of 12 or more, and a ratio of {554}<225> intensity to {111}<110> intensity of 7 or more are achieved.

Figure 5:
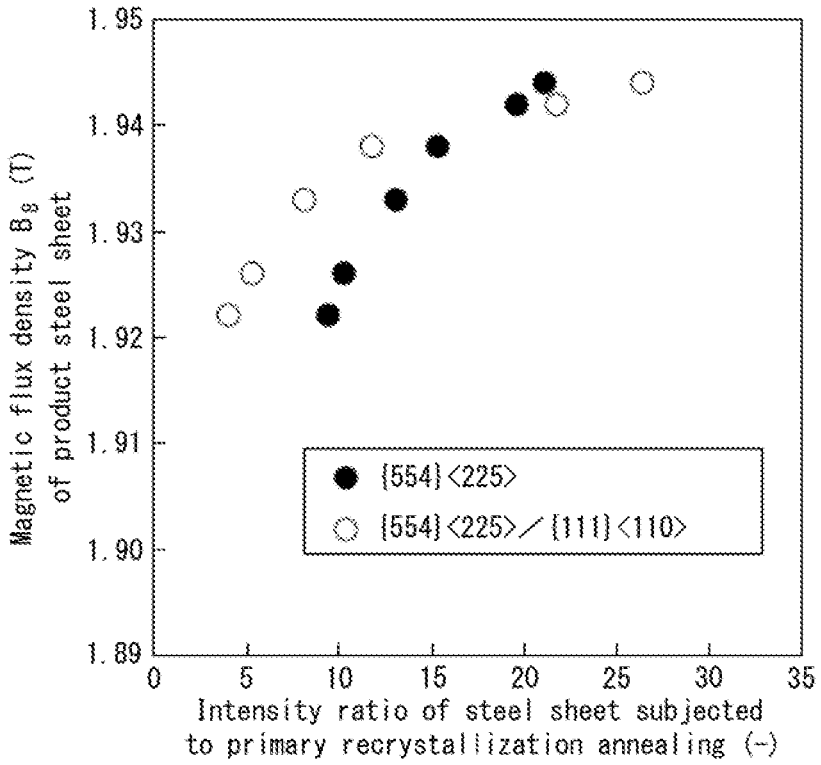
FIG. 5 is a graph showing the influence of the ratio of {554}<225> intensity to random intensity and the ratio of {554}<225> intensity to {111}<110> intensity of the center layer in the sheet thickness direction of the steel sheets subjected to primary recrystallization annealing on the magnetic flux density $B_8$ of the product steel sheets.

FIG. 5 shows the results of studying the influence of the ratio of {554}<225> intensity to random intensity and the ratio of {554}<225> intensity to {111}<110> intensity of the center layer in the sheet thickness direction of the steel sheets subjected to primary recrystallization annealing on the magnetic flux density $B_8$ of the product steel sheets.

It can be seen from FIG. 5 that when the ratio of {554}<225> intensity to random intensity is 12 or more, and the ratio of {554}<225> intensity to {111}<110> intensity is 7 or more in the center layer in the sheet thickness direction of the steel sheet subjected to primary recrystallization annealing, a magnetic flux density ($B_8$) of 1.93 T or more is achieved.

The above results clearly show that, when increasing the magnetic flux density of the product steel sheet, the aging index AI of the steel sheet before final cold rolling can be reduced by controlling the cooling rate between 800° C. and 200° C. after hot band annealing to or lower than the upper limit average cooling rate $R_H$ calculated by the C content and Si content in the material, and hence, it is important to reduce solute C content.

Further, it was revealed that when the average heating rate between 500° C. and 700° C. in primary recrystallization annealing is adjusted to 100° C./s or lower, and the ratio of {554}<225> intensity to random intensity is 12 or more and the ratio of {554}<225> intensity to {111}<110> intensity is 7 or more in the center layer in the sheet thickness direction of the steel sheet subjected to primary recrystallization annealing, the magnetic flux intensity can be further increased.

It is not necessarily clear why the ratio of {554}<225> intensity to random intensity and the ratio of {554}<225> intensity to {111}<110> intensity of the steel sheet subjected to primary recrystallization annealing increases as the aging index of the steel sheet before final cold rolling is reduced, in other words, as the solute C content is reduced. However, it is thought to be due to the following reasons.

If the C content of the material is reduced, the solute C content in grains as well as the amount of precipitates in grain boundaries are reduced, and therefore the restraining force in grain boundaries is reduced. As a result, locally deformed areas caused by shear bands during cold rolling are reduced and highly oriented cold rolled textures are formed. Further, by controlling the cooling rate between 800° C. and 200° C. after hot band annealing to or lower than the upper limit average cooling rate $R_H$ calculated by the C content and Si content of the material, the aging index AI of the steel sheet before final cold rolling can be effectively reduced. It is thought that, as a result of the above, the {554}<225> orientation which is the primary orientation in primary recrystallization annealing, was highly oriented.

It is not necessarily clear why the ratio of {554}<225> intensity to random intensity and the ratio of {554}<225> intensity to {111}<110> intensity of the steel sheet subjected to primary recrystallization annealing is increased by adjusting the heating rate in primary recrystallization annealing to 100° C./s or lower. However, it is thought to be due to the following reasons.

During primary recrystallization annealing, since the energy stored during rolling is different depending on each crystal orientation, it is known that recrystallization starts from the orientation with a large amount of stored energy. Increasing the heating rate in primary recrystallization annealing will eliminate the difference in stored energy to thereby randomize the primary recryatallized texture, and an effect opposite to that of the technical concept of the disclosure will be brought about. Therefore, the heating rate is preferably low, and in the disclosure, it is thought that a good primary recrystallized texture is formed if the heating rate between 500° C. and 700° C. is 100° C./s or lower. As for the lower limit of the heating rate, a heating rate capable of completing primary recrystallization in a short period of time is preferable assuming that continuous annealing is to be performed, and from such perspective, the lower limit of the heating rate was set to 10° C./s.

It is not necessarily clear why the magnetic flux density of the steel sheet subjected to secondary recrystallization annealing is increased as the ratio of {554}<225> intensity to random intensity and the ratio of {554}<225> intensity to {111}<110> intensity are increased. However, it is thought to be due to the following reasons.

It can be seen from Materials Transactions. Vol. 54 No. 01 (2013) pp. 14-21 (NPL 1) that, based on the theory of secondary recrystallization by the model of high-energy boundaries, grain boundaries with a misorientation angle between 25° to 40° have high mobility. In other words, by forming a primary recrystallized texture having a misorientation angle of 25° to 40° to the Goss orientation, highly Goss-oriented grains are selected during secondary recrystallization. The misorientation angle to the Goss orientation is 29.5° for the {554}<225> orientation, and 46.0° for the {111}<110> orientation. Further, the misorientation angle to the orientation rotated around the ND//<110> axis by 20° from the Goss orientation is 35.5° for the {554}<225> orientation, and 36.6° for the {111}<110> orientation. In other words, the existence of {111}<110> oriented primary recrystallized grains facilitates the selection of grains oriented in an orientation displaced from the Goss orientation with ND//<110> being the axis, when selecting secondary recrystallization nuclei, and deteriorates magnetic properties of the product steel sheet. Therefore, in order to achieve an increase of magnetic flux density of the steel sheet subjected to secondary recrystallization annealing, it is thought to be essential to increase {554}<225> primary recrystallized grains and reduce {111}<110> oriented primary recrystallized grains.

The chemical compositions of the steel slab as the material will be described below.

C: 0.0005% or more and 0.005% or less

C is one of the features of the disclosure. As previously mentioned, from the perspective of improving characteristics, omitting decarburization annealing and the like, it is preferable for C content to be as low as possible, and therefore it is limited to 0.005% or less. On the other hand, considering the increase in costs resulting from an increase in decarburization load when adjusting components as well as the modern refining technique, the lower limit of C content was set to be 0.0005%, as a practical content. However, even in a case where C content exceeds 0.005%, if it is possible to reduce solute C content by performing precipitation treatment before final cold rolling, specifically, by performing annealing for a long period of time between 100° C. and 500° C., and subsequent gradual cooling in the degree of furnace cooling, an effect equivalent to that of the disclosure is obtained.

Si: 2.0% or more and 4.5% or less

Si is a very effective element for enhancing electrical resistance of steel and reducing eddy current loss which constitutes a part of iron loss. By adding Si to the steel sheet, electrical resistance monotonically increases until the content reaches 11%. However, when the content exceeds 4.5%, workability significantly decreases. On the other hand, if C content is less than 2.0%, the electrical resistance becomes too small and good iron loss properties cannot be obtained. Therefore, Si content is to be in the range of 2.0% or more and 4.5% or less.

Mn: 0.005% or more and 0.3% or less

Mn bonds with S or Se to form MnS or MnSe which act as inhibitors for inhibiting normal grain growth in the heating process of secondary recrystallization annealing. However, if Mn content is less than 0.005%, the absolute content of the inhibitor will be insufficient, and thus the inhibition effect on normal grain growth will be insufficient. On the other hand, if Mn content exceeds 0.3%, not only will it be necessary to perform slab heating at a high temperature in the slab heating process before hot rolling to completely dissolve Mn, but the inhibitor will be formed as a coarse precipitate, and thus the inhibition effect on normal grain growth will be insufficient. Therefore, Mn content is to be in the range of 0.005% or more and 0.3% or less.

S and/or Se (in total): 0.05% or less

Although S and Se bond with Mn to form an inhibitor, if the total content of one or both of S and Se is less than 0.001%, the absolute content as a minute amount inhibitor will be insufficient, and thus the inhibition effect on normal grain growth will be insufficient. Therefore, S and Se are preferably contained in an amount of 0.001% or more. However, if the content thereof exceeds 0.05%, desulfurization and deselenization become incomplete in secondary recrystallization annealing and leads to deterioration of iron loss properties. Therefore, the total content of one or both elements selected from S and Se is to be 0.05% or less. In order to more effectively exhibit the effect of adding S or Se, the total content thereof is preferably 0.01% or more.

sol.Al: 0.01% or more and 0.04% or less

Sol.Al is an important element in a grain oriented electrical steel sheet since AlN serves as an inhibitor in inhibiting normal grain growth in the heating process of secondary recrystallization annealing. However, if sol.Al content is less than 0.01%, the absolute content of the inhibitor will be insufficient, and thus the inhibition effect on normal grain growth will be insufficient. On the other hand, if sol.Al content exceeds 0.04%, AlN is formed as a coarse precipitate, and thus the inhibition effect on normal grain growth will be insufficient. Therefore, sol.Al content is to be in a range of 0.01% or more and 0.04% or less.

N: 0.005% or less

Although N bonds with Al to form an inhibitor, it is important to minimize N content in the slab stage to increase solute Al content. This enables effectively exhibiting the effect of strengthening the suppressing force of the inhibitor by nitriding treatment of additional inhibitor treatment. Therefore, N content is to be 0.005% or less.

Although the basic components of the disclosure are as explained above, the following elements may also be added as necessary.

Ni: 0.005% or more and 1.5% or less

Ni is an austenite forming element and therefore it is a useful element for improving the texture of a hot-rolled sheet and enhancing magnetic properties by using austenite transformation. However, if Ni content is less than 0.005%, it is less effective for improving magnetic properties. On the other hand, if Ni content exceeds 1.5%, workability decreases and leads to deterioration of sheet threading performance, and secondary recrystallization becomes unstable and causes deterioration of magnetic properties. Therefore, Ni content is to be in a range of 0.005% to 1.5%.

Sn: 0.005% or more and 0.50% or less, Sb: 0.005% or more and 0.50% or less, Cu: 0.005% or more and 1.5% or less, Cr: 0.005% or more and 0.10% or less, P: 0.005% or more and 0.50% or less, and Mo: 0.005% or more and 0.50% or less Sn, Sb, Cu, Cr, P, and Mo are all effective elements for improving magnetic properties. However, if the content of each element is less than the lower limit values of each of the above ranges, the effect of improving magnetic properties is poor, whereas if the content of each element exceeds the upper limit values of each of the above ranges, secondary recrystallization becomes unstable and causes deterioration of magnetic properties. Therefore, Sn, Sb, Cu, Cr, P, and Mo are each to be contained in the following ranges, Sn: 0.005% or more and 0.50% or less, Sb: 0.005% or more and 0.50% or less, Cu: 0.005% or more and 1.5% or less, Cr: 0.005% or more and 0.10% or less, P: 0.005% or more and 0.50% or less, and Mo: 0.005% or more and 0.50% or less.

Ti: 0.001% or more and 0.1% or less, Nb: 0.001% or more and 0.1% or less, and V: 0.001% or more and 0.1% or less Ti, Nb, and V are all elements which precipitate as carbides and nitrides and are effective for reducing solute C and N. However, if the content of each element is less than the lower limit values of each of the above ranges, the effect of improving magnetic properties is poor, whereas if the content of each element exceeds the upper limit values of each of the above ranges, precipitates consisting of these elements remaining in the product steel sheet cause deterioration of iron loss properties. Therefore, Ti, Nb, and V are each to be contained in the following ranges, Ti: 0.001% or more and 0.1% or less, Nb: 0.001% or more and 0.1% or less, and V: 0.001% or more and 0.1% or less.

Our production method will be described next.

A steel slab having the above chemical composition is heated and subjected to hot rolling. The slab heating temperature is to be 1250° C. or lower. This is because, as the slab heating temperature is lowered, the grain size of the slab is refined and the amount of strains accumulated during hot rolling increases, and thus it is effective for refining the texture of the hot rolled sheet.

After hot rolling, the texture of the hot rolled sheet can be improved by optionally performing hot band annealing. Hot band annealing at this time is preferably performed under the conditions of soaking temperature: 800° C. or higher and 1200° C. or lower, soaking time: 2 seconds or more and 300 seconds or less.

If the soaking temperature in hot band annealing is lower than 800° C. the texture of the hot rolled sheet is not completely improved, non-recrystallized parts remain, and thus a desirable microstructure may not be obtained. On the other hand, if the soaking temperature exceeds 1200° C., dissolution of AlN, MnSe and MnS proceeds, the inhibition effect of inhibitor in the secondary recrystallization process becomes insufficient, secondary recrystallization is suspended, and as a result, magnetic properties are deteriorated. Therefore, the soaking temperature in hot band annealing is preferably in the range of 800° C. or higher and 1200° C. or lower.

Further, if the soaking time is less than 2 seconds, non-recrystallized parts remain because of the short high-temperature holding time, and a desirable microstructure may not be obtained. On the other hand, if the soaking time exceeds 300 seconds, dissolution of AlN, MnSe and MnS proceeds, the effect of the minute amount inhibitor decreases, the texture before nitriding treatment becomes non-uniform, and as a result, magnetic properties of the steel sheet subjected to secondary recrystallization annealing are deteriorated. Therefore, the soaking time in hot band annealing is preferably 2 seconds or more and 300 seconds or less.

In a case where intermediate annealing described below is not performed, the cooling treatment after hot band annealing is one feature of the disclosure. As in the aforementioned experiment, by controlling the cooling rate between 800° C. and 200° C. after hot band annealing to or lower than the upper limit average cooling rate $R_H$ calculated by the C content and Si content of the material, the aging index AI of the steel sheet before final cold rolling is reduced to 70 MPa or less, and this enables obtaining good magnetic properties.

The average cooling rate during cooling is to be controlled for the temperature range of 800° C. to 200° C. because this temperature range is the precipitation temperature range for carbides ($Fe_3C$, ε-cabide, and the like) and nitrides (AlN, $Si_3N_4$, and the like). By adjusting the average cooling rate in this temperature range, formation of solute C and N can be effectively reduced.

Since it is important to reduce the solute C content of the steel sheet before final cold rolling, in a case where hot band annealing is not performed, and the steel sheet is rolled to a final thickness by performing cold rolling once (i.e. without performing intermediate annealing), it is important to reduce solute C content of the hot rolled sheet. In other words, in such case, it would suffice to control the average cooling rate R (° C./s) between 800° C. and 200° C. after hot rolling to or lower than the upper limit average cooling rate $R_H$ calculated by C content and Si content of the material.

In the disclosure, the steel sheet of final thickness may be obtained by subjecting the steel sheet to cold rolling twice or more with intermediate annealing performed therebetween after hot band annealing or without hot band annealing. In this case, intermediate annealing is preferably performed at a soaking temperature of 800° C. or higher and 1200° C. or lower, and for a soaking time of 2 seconds or more and 300 seconds or less based on the same reasons as for the limitations for hot band annealing. Further, by controlling the cooling rate between 800° C. and 200° C. after intermediate annealing to or lower than the upper limit average cooling rate $R_H$ calculated by the C content and Si content of the material, the aging index AI of the steel sheet after final cold rolling can be reduced to 70 MPa or less, and this enables obtaining good magnetic properties.

As described above, the following cooling rates are set to or lower than the upper limit average cooling rate $R_H$ calculated from the C content and Si content of the material depending on the process followed to manufacture the steel sheet, i.e. in a case where intermediate annealing is performed: the cooling rate between 800° C. and 200° C. after intermediate annealing, in a case where hot band annealing is performed without intermediate annealing: the cooling rate between 800° C. and 200° C. after hot band annealing, and in a case where neither intermediate annealing nor hot band annealing is performed: the average cooling rate between 800° C. and 200° C. after hot rolling. In other words, it is important to control the average cooling rate between 800° C. and 200° C. after the heating process right before final cold rolling.

As for cold rolling, when the rolling reduction in final cold rolling is 80% or more and 95% or less, an even better texture of steel sheet subjected to primary recrystallization annealing can be obtained.

After the above cold rolling, the cold rolled sheet is subjected to primary recrystallization annealing preferably at a soaking temperature of 700° C. or higher and 1000° C. or lower. Further, the primary recrystallization annealing may be performed in, for example, wet hydrogen atmosphere to additionally obtain the effect of decarburization of the steel sheet. Here, if the soaking temperature in primary recrystallization annealing is lower than 700° C., non-recrystallized parts remain, and thus a desirable microstructure may not be obtained. On the other hand, if the soaking temperature exceeds 1000° C., secondary recrystallization of Goss orientation grains may occur. Therefore, the soaking temperature in primary recrystallization annealing is preferably set to be in a range of 700° C. or higher and 1000° C. or lower.

As in the aforementioned experiment, by setting the heating rate in primary recrystallization annealing between 500° C. and 700° C. to 10° C./s or higher and 100° C./s or lower, better magnetic properties may be obtained. Here, the heating rate is to be adjusted for the temperature range of 500° C. to 700° C. because nuclei of recrystallized grains are generated in this temperature range.

Further, nitriding treatment may be applied in any stage between primary recrystallization annealing and secondary recrystallization annealing, as an additional inhibitor treatment. As the nitriding treatment, known techniques such as gas nitriding performed by heat treatment in ammonia atmosphere after primary recrystallization annealing, salt bath nitriding performed by heat treatment in a salt bath, plasma nitriding, addition of nitrides to the annealing separator, and use of nitriding atmosphere as the secondary recrystallization annealing atmosphere, may be applied.

Then, an annealing separator mainly composed of MgO is optionally applied to the steel sheet surface, and then the steel sheet is subjected to secondary recrystallization. As additional inhibitor treatment, one or more elements selected from sulfide, sulfate, selenide, and selenate may be added to the annealing separator. These additives dissolve during secondary recrystallization annealing, and then causes sulfurizing and selenizing in steel, to thereby provide an inhibiting effect. Annealing conditions of secondary recrystallization annealing are not particularly limited, and conventionally known annealing conditions may be applied. Further, by applying a hydrogen atmosphere as the annealing atmosphere, the effect of purification annealing may also be obtained. Then, after an insulating coating application process and a flattening annealing process, a desired grain oriented electrical steel sheet is obtained. There is no particular restriction regarding the producing conditions of the insulating coating application process and the flattening annealing process, and these processes may be performed in accordance with conventional methods.

A grain oriented electrical steel sheet produced by satisfying the above conditions has an extremely high magnetic flux density as well as low iron loss properties after secondary recrystallization. In this regard, having a high magnetic flux density, means that the crystal grains were allowed to preferentially grow only in orientations in the vicinity of the just (ideal) Goss orientation during the secondary recrystallization process. It is known that the closer to the just Goss orientation the secondary recrystallized grains are, the more the growth rate of secondary recrystallized grains increases, and thus an increase in magnetic flux density indicates that secondary recrystallized grain size is potentially coarse. This is advantageous in terms of reducing hysteresis loss, but disadvantageous in terms of reducing eddy current loss.

Therefore, in order to solve such offsetting problem for the ultimate goal of the technique i.e. reduction of iron loss, it is preferable to perform magnetic domain refining treatment. By performing an appropriate magnetic domain refinement, the disadvantageous eddy-current loss caused by coarsening of secondary recrystallized grains will be reduced, and together with the hysteresis loss-reducing effect, significantly low iron loss properties can be obtained.

As magnetic domain refining treatment, any conventionally known heat resistant or non-heat resistant magnetic domain refining treatment method may be applied, and by applying a method of irradiating the steel sheet surface with an electron beam or laser beam to after secondary recrystallization annealing, the magnetic domain refining effect can spread to the inner part in the thickness direction of the steel sheet, and thus iron loss can be significantly reduced as compared to applying other magnetic domain refining treatment such as the etching method.

EXAMPLES

Example 1

Steel slabs having the chemical compositions shown in Table 1 were heated to 1180° C., and then subjected to hot rolling to obtain hot rolled sheets with thickness of 2.3 mm.

Then, the hot rolled sheets were subjected to hot band annealing at 1020° C. for 60 seconds, subsequently cooled between 800° C. and 200° C. at an average cooling rate of 40° C./s, and then subjected to cold rolling to obtain cold rolled sheets with thickness of 0.23 mm which in turn were subjected to primary recrystallization annealing in a mixed atmosphere of wet hydrogen-nitrogen at 820° C. for 120 seconds. The heating rate between 500° C. and 700° C. in primary recrystallization annealing was 20° C./s.

Then, annealing separators, each mainly composed of MgO were applied to the steel sheet surfaces, and then the cold rolled sheets were subjected to secondary recrystallization annealing combined with purification annealing at 1180° C. for 50 hours, and subsequently a phosphate-based insulation tension coating was applied and baked on the steel sheets, and flattening annealing was performed for the purpose of flattening the resulting steel strips to obtain products.

The results of studying the magnetic properties of the products thus obtained are also shown in Table 1. Table 1 also shows results of studying the aging index AI of the steel sheets before final cold rolling i.e. the steel sheets subjected to hot band annealing and the texture of the center layer in the sheet thickness direction of the steel sheets subjected to primary recrystallization annealing.

TABLE 1

| | Chemical Composition (mass %) | | | | | | | Upper limit cooling rate $R_H$ | Steel Sheet Subjected to Hot Band Annealing |
|---|---|---|---|---|---|---|---|---|---|
| No. | Si | C | Mn | S | Se | sol. Al | N | (° C./s) | AI (MPa) |
| 1 | 2.88 | 0.0024 | 0.061 | 0.033 | 0.001 | 0.016 | 0.004 | 82 | 9 |
| 2 | 3.18 | 0.0029 | 0.092 | 0.004 | 0.012 | 0.033 | 0.003 | 73 | 22 |
| 3 | 3.40 | 0.0038 | 0.077 | 0.006 | 0.004 | 0.023 | 0.002 | 65 | 39 |
| 4 | 3.28 | 0.0090 | 0.065 | 0.015 | 0.010 | 0.016 | 0.004 | 52 | 77 |
| 5 | 4.11 | 0.0019 | 0.083 | 0.014 | 0.006 | 0.017 | 0.003 | 62 | 39 |
| 6 | 3.44 | 0.0008 | 0.071 | 0.019 | 0.001 | 0.019 | 0.002 | 77 | 25 |
| 7 | 3.39 | 0.0020 | 0.240 | 0.002 | 0.003 | 0.024 | 0.004 | 73 | 36 |
| 8 | 3.72 | 0.0035 | 0.180 | 0.004 | 0.003 | 0.025 | 0.003 | 62 | 50 |
| 9 | 3.66 | 0.0041 | 0.059 | 0.002 | 0.022 | 0.013 | 0.003 | 61 | 39 |
| 10 | 3.92 | 0.0036 | 0.080 | 0.005 | 0.010 | 0.011 | 0.003 | 59 | 35 |

| | Steel Sheet Subjected to Primary Crystallization Annealing | | | Product Steel Sheet | | |
|---|---|---|---|---|---|---|
| No. | {554}<225> (x random) | {111}<110> (x random) | {554}<225>/{111}<110> (x random) | $B_8$ (T) | $W_{17/50}$ (W/kg) | Remarks |
| 1 | 22.9 | 0.8 | 25.7 | 1.945 | 0.781 | Example |
| 2 | 18.8 | 1.1 | 15.0 | 1.941 | 0.804 | Example |
| 3 | 15.8 | 1.4 | 8.8 | 1.928 | 0.844 | Example |
| 4 | 9.2 | 2.0 | 5.1 | 1.908 | 0.881 | Comparative Example |
| 5 | 16.3 | 1.2 | 16.8 | 1.929 | 0.839 | Example |
| 6 | 18.3 | 1.1 | 11.1 | 1.938 | 0.825 | Example |
| 7 | 15.0 | 1.3 | 8.3 | 1.935 | 0.836 | Example |
| 8 | 13.4 | 1.4 | 12.7 | 1.933 | 0.830 | Example |
| 9 | 15.9 | 1.3 | 12.6 | 1.923 | 0.851 | Example |
| 10 | 16.7 | 1.2 | 12.9 | 1.925 | 0.835 | Example |

It can be seen from Table 1 that when the aging index AI of the steel sheet before final cold rolling i.e. the steel sheet subjected to hot band annealing is 70 MPa or less and the ratio of {554}<225> intensity to random intensity is 12 or more, and the ratio of {554}<225> intensity to {111}<110> intensity is 7 or more in the texture of the center layer in the sheet thickness direction of the steel sheet subjected to primary recrystallization annealing, magnetic flux density $B_8$ after secondary recrystallization annealing of 1.92 T or more can be achieved.

Example 2

Steel slabs of Nos. 3 and 4 in Table 1 were heated to 1220° C. and then subjected to hot rolling to obtain hot rolled sheets with various thickness shown in Table 2. Then, the hot rolled sheets were subjected to hot band annealing at 1050° C. for 30 seconds, subsequently cooled between 800° C. and 200° C. at an average cooling rate of 20° C./s, and then subjected to cold rolling to obtain cold rolled sheets with thickness of 0.20 mm which in turn were subjected to primary recrystallization annealing in a mixed atmosphere of wet hydrogen-nitrogen at 820° C. for 120 seconds. The heating rate between 500° C. and 700° C. in primary recrystallization annealing was 30° C./s.

Then, annealing separators, each composed of MgO with 10 parts by mass of $MgSO_4$ per 100 parts by mass of MgO added thereto were applied to the steel sheet surfaces, and then the cold rolled sheets were subjected to secondary recrystallization annealing combined with purification annealing at 1180° C. for 50 hours, and subsequently a phosphate-based insulation tension coating was applied and baked on the steel sheets, and flattening annealing was performed for the purpose of flattening the resulting steel strips to obtain products.

The results of studying the magnetic properties of the products thus obtained are also shown in Table 2. Table 2 also shows results of studying the aging index AI of the steel sheets subjected to hot band annealing and the texture of the center layer in the sheet thickness direction of the steel sheets subjected to primary recrystallization annealing.

TABLE 2

| No. | Rolling Process: Sheet Thickness of Hot Rolled Sheet (mm) | Rolling Process: Sheet Thickness of Product Steel Sheet (mm) | Rolling Process: Rolling Reduction in Final Cold Rolling (%) | Steel Sheet Subjected to Hot Band Annealing AI (MPa) | Steel Sheet Subjected to Primary Crystallization Annealing: {544}<225> (x random) | Steel Sheet Subjected to Primary Crystallization Annealing: {111}<110> (x random) | Steel Sheet Subjected to Primary Crystallization Annealing: {554}<225>/{111}<110> (x random) | Product Steel Sheet: $B_8$ (T) | Product Steel Sheet: $W_{17/50}$ (W/kg) | Remarks |
|---|---|---|---|---|---|---|---|---|---|---|
| 3-a | 1.2 | 0.20 | 83.3 | 34 | 13.9 | 1.0 | 13.9 | 1.952 | 0.775 | Example |
| 3-b | 2.0 | 0.20 | 90.0 | 36 | 15.4 | 1.0 | 15.4 | 1.955 | 0.769 | Example |
| 3-c | 3.0 | 0.20 | 93.3 | 37 | 15.8 | 0.8 | 19.8 | 1.957 | 0.762 | Example |
| 3-d | 4.0 | 0.20 | 95.0 | 39 | 16.5 | 0.7 | 23.6 | 1.958 | 0.767 | Example |
| 4-a | 1.2 | 0.20 | 83.3 | 76 | 7.7 | 2.2 | 3.5 | 1.911 | 0.944 | Comparative Example |
| 4-b | 2.0 | 0.20 | 90.0 | 80 | 9.6 | 2.0 | 4.8 | 1.918 | 0.920 | Comparative Example |
| 4-c | 3.0 | 0.20 | 93.3 | 81 | 10.4 | 1.8 | 5.8 | 1.909 | 0.934 | Comparative Example |
| 4-d | 4.0 | 0.20 | 95.0 | 79 | 10.8 | 1.7 | 6.4 | 1.914 | 0.921 | Comparative Example |

It can be seen from Table 2 that when the AI value of the steel sheets before final cold rolling i.e. the steel sheets subjected to hot band annealing is 70 MPa or less, and the ratio of {554}<225> intensity to random intensity is 12 or more and the ratio of {554}<225> intensity to {111}<110> intensity is 7 or more in the texture of the center layer in the sheet thickness direction of the steel sheet subjected to primary recrystallization annealing, magnetic flux density $B_8$ after secondary recrystallization annealing of 1.95 T or more can be achieved. Further, as the rolling reduction in final cold rolling is increased, the {554}<225> intensity and the ratio of {554}<225> intensity to {111}<10> intensity of the texture of the center layer in the sheet thickness direction of the steel sheet subjected to primary recrystallization annealing are significantly increased, and thus the magnetic properties $B_8$ of the steel sheet subjected to secondary recrystallization annealing are significantly increased compared to that of other examples.

Example 3

Steel slabs having various chemical compositions shown in Table 3 were heated to 1220° C., and then subjected to hot rolling to obtain hot rolled sheets with thickness of 2.7 mm. Then, the hot rolled sheets were subjected to the first cold rolling to obtain cold rolled sheets with an intermediate thickness of 2.2 mm, and then the cold rolled sheets were subjected to intermediate annealing at 950° C. for 60 seconds, and then cooled between 800° C. and 200° C. at an average cooling rate of 40° C./s, and then the cold rolled sheets were subjected to the second cold rolling to obtain cold rolled sheets with final thickness of 0.23 mm which in turn were subjected to primary recrystallization annealing at 840° C. for 10 seconds. The heating rate between 500° C. and 700° C. in primary recrystallization annealing was 40° C./s.

Then, the cold rolled sheets were subjected to nitriding treatment in a cyanate bath at 600° C. for 3 minutes. Then, annealing separators, each mainly composed of MgO were applied to the steel sheet surfaces, and then the cold rolled sheets were subjected to secondary recrystallization annealing combined with purification annealing at 1200° C. for 50 hours, and subsequently phosphate-based insulation tension coating was applied and baked on the steel sheets, and flattening annealing was performed for the purpose of flattening the resulting steel strips to obtain products.

The results of studying the magnetic properties of the products thus obtained are shown in Table 4. Table 4 also shows the results of studying the aging index AI of the steel sheets subjected to hot band annealing and the texture of the center layer in the sheet thickness direction of the steel sheets subjected to primary recrystallization annealing.

TABLE 3

| No. | Chemical Composition (mass %): Si | C | Mn | S | Se | Al | N | Others |
|---|---|---|---|---|---|---|---|---|
| 1 | 3.15 | 0.0022 | 0.072 | 0.003 | 0.002 | 0.028 | 0.004 | Ni: 0.26 |
| 2 | 3.24 | 0.0031 | 0.066 | 0.021 | — | 0.024 | 0.003 | Sn: 0.15 |
| 3 | 3.71 | 0.0024 | 0.083 | 0.003 | 0.011 | 0.011 | 0.003 | Sb: 0.06 |
| 4 | 3.40 | 0.0038 | 0.064 | 0.008 | 0.002 | 0.022 | 0.004 | Cu: 0.12 |
| 5 | 3.66 | 0.0036 | 0.070 | 0.003 | 0.019 | 0.020 | 0.004 | Cr: 0.06 |
| 6 | 3.37 | 0.0044 | 0.081 | 0.002 | 0.017 | 0.013 | 0.005 | P: 0.10 |
| 7 | 3.92 | 0.0026 | 0.093 | 0.007 | 0.004 | 0.032 | 0.003 | Mo: 0.05 |
| 8 | 2.88 | 0.0027 | 0.067 | 0.008 | 0.003 | 0.021 | 0.004 | Tr 0.04 |
| 9 | 3.51 | 0.0030 | 0.074 | 0.003 | 0.003 | 0.016 | 0.003 | Nb: 0.006 |
| 10 | 4.04 | 0.0031 | 0.106 | 0.012 | 0.009 | 0.022 | 0.004 | V: 0.015 |
| 11 | 3.36 | 0.0027 | 0.074 | 0.003 | 0.008 | 0.020 | 0.004 | Sn: 0.06, Sb: 0.06, Cu: 0.15, P: 0.03 |
| 12 | 3.26 | 0.0038 | 0.076 | 0.003 | 0.003 | 0.023 | 0.004 | Sn: 0.05, Cu: 0.08, Ti: 0.004 |
| 13 | 3.51 | 0.0046 | 0.082 | 0.003 | 0.014 | 0.027 | 0.004 | Sb: 0.07, Cu: 0.10, Ti: 0.004, Nb: 0.004 |
| 14 | 3.12 | 0.0040 | 0.083 | 0.002 | 0.010 | 0.027 | 0.003 | Ni: 0.15, Cr: 0.06, Mo: 0.06, V: 0.003 |

TABLE 4

| No. | Upper Limit Cooling Rate $R_H$ (° C./s) | Steel Sheet Subjected to Hot Band Annealing AI (MPa) | Steel Sheet Subjected to Primary Crystallization Annealing {554}<225> (x random) | {111}<110> (x random) | {554}<225>/{111}<110> (x random) | Product Steel Sheet $B_8$ (T) | $W_{17/50}$ (W/kg) | Remarks |
|---|---|---|---|---|---|---|---|---|
| 1 | 77 | 24 | 15.4 | 0.9 | 17.1 | 1.953 | 0.785 | Example |
| 2 | 71 | 34 | 14.8 | 1.0 | 14.8 | 1.951 | 0.790 | Example |
| 3 | 66 | 26 | 16.1 | 0.8 | 20.1 | 1.953 | 0.784 | Example |
| 4 | 65 | 42 | 13.7 | 1.2 | 11.4 | 1.953 | 0.788 | Example |
| 5 | 62 | 41 | 13.9 | 1.3 | 10.7 | 1.954 | 0.782 | Example |
| 6 | 64 | 49 | 12.8 | 1.2 | 10.7 | 1.955 | 0.788 | Example |
| 7 | 62 | 31 | 15.5 | 1.0 | 15.5 | 1.954 | 0.782 | Example |
| 8 | 80 | 16 | 17.0 | 0.8 | 21.3 | 1.957 | 0.779 | Example |
| 9 | 67 | 20 | 16.3 | 0.9 | 18.1 | 1.958 | 0.780 | Example |
| 10 | 59 | 23 | 15.0 | 0.9 | 16.7 | 1.956 | 0.781 | Example |
| 11 | 70 | 38 | 13.7 | 1.1 | 12.5 | 1.953 | 0.794 | Example |
| 12 | 68 | 23 | 15.3 | 1.0 | 15.3 | 1.957 | 0.778 | Example |
| 13 | 61 | 30 | 14.4 | 1.1 | 13.1 | 1.959 | 0.774 | Example |
| 14 | 69 | 45 | 13.1 | 1.2 | 10.9 | 1.956 | 0.781 | Example |

It can be seen from Table 4 that when the AI value of the steel sheets before final cold rolling i.e. the steel sheets subjected to hot band annealing is 70 MPa or less, and the ratio of {554}<225> intensity to random intensity is 12 or more and the ratio of {554}<225> intensity to {111}<110> intensity is 7 or more in the texture of the center layer in the sheet thickness direction of the steel sheet subjected to primary recrystallization annealing, magnetic flux density Bs after secondary recrystallization annealing of 1.95 T or more can be achieved.

Example 4

For the samples of Nos. 3 and 12 shown in Tables 3 and 4, experiments were performed to confirm the effect of magnetic domain refining treatment shown in Table 5.

Here, etching was performed to form grooves having widths of 80 μm, depths of 15 μm, rolling direction intervals of 5 mm in the direction orthogonal to the rolling direction on one surface of each cold rolled sheet. Then, the cold rolled sheets were subjected to primary recrystallization annealing at 840° C. for 20 seconds. The heating rate between 500° C. and 700° C. in primary recrystallization annealing was 30° C./s. Then, the cold rolled sheets were subjected to gas nitriding treatment in a mixed atmosphere of ammonia, nitrogen and hydrogen at 750° C. for 30 seconds. Then, annealing separators, each mainly composed of MgO were applied to the steel sheet surfaces, and then the cold rolled sheets were subjected to secondary recrystallization annealing combined with purification annealing at 1180° C. for 50 hours, and subsequently a phosphate-based insulation tension coating was applied and baked on the steel sheets, and flattening annealing was performed for the purpose of flattening the resulting steel strips to obtain products.

An electron beam was continuously irradiated on one surface of each steel sheet subjected to flattening annealing in the direction orthogonal to the rolling direction under the conditions of an acceleration voltage of 80 kV, irradiation interval of 4 mm, and beam current of 3 mA.

A continuous laser beam was continuously irradiated on one surface of each steel sheet subjected to flattening annealing in the direction orthogonal to the rolling direction under the conditions of beam diameter of 0.3 mm, output of 200 W, scanning rate of 100 m/s, and irradiation interval of 4 mm.

The results of studying the magnetic properties of the products thus obtained are also shown in Table 5.

TABLE 5

| No. | Magnetic Domain Refining Treatment | Product Steel Sheet $B_8$ (T) | $W_{17/50}$ (W/kg) | Remarks |
|---|---|---|---|---|
| 3 | None | 1.954 | 0.789 | Example |
| 3-X | Etching Groove | 1.917 | 0.704 | Example |
| 3-Y | Electron Beam | 1.949 | 0.668 | Example |
| 3-Z | Continuous Laser | 1.948 | 0.671 | Example |
| 12 | None | 1.958 | 0.781 | Example |
| 12-X | Etching Groove | 1.919 | 0.701 | Example |
| 12-Y | Electron Beam | 1.944 | 0.664 | Example |
| 12-Z | Continuous Laser | 1.943 | 0.667 | Example |

It can be seen from Table 5 that by performing magnetic domain refining treatment, even better magnetic properties are obtained.

The invention claimed is:

1. A method of producing a grain oriented electrical steel sheet, the method comprising:

heating a steel slab having a composition containing by mass %

C: 0.0005% to 0.005%,

Si: 2.0% to 4.5%,

Mn: 0.005% to 0.3%,

S and/or Se (in total): 0.05% or less, sol.Al: 0.010% to 0.04%,

N: 0.005% or less, and the balance being Fe and incidental impurities;

then subjecting the slab to hot rolling to obtain a hot rolled sheet;

then optionally subjecting the hot rolled sheet to hot band annealing;

then subjecting the hot rolled sheet to cold rolling once, or twice or more with intermediate annealing performed therebetween to obtain a cold rolled sheet with final sheet thickness; and then subjecting the cold rolled sheet to primary recrystallization annealing;

then subjecting the cold rolled sheet to secondary recrystallization annealing, wherein a solute C content parameter X calculated from the following formula (1) is used, and an average cooling rate R (° C./s) between 800° C. and 200° C. after a heating process right before final cold rolling is set to or lower than an upper limit average cooling rate $R_H$ calculated from the following formula (2) to achieve an aging index AI of the steel sheet before the final cold rolling of 70 MPa or less, $$X=[\%Si]/28.09+100[\%C]/12.01 \quad (1)$$

$$R_H=10/X \quad (2)$$

where [%M] in formula (1) represents the content of element M (mass %).

2. The method of producing a grain oriented electrical steel sheet according to claim 1, wherein an average heating rate between 500° C. and 700° C. in the primary recrystallization annealing is adjusted to 10° C./s or higher and 100° C./s or lower to achieve a ratio of {554}<225> intensity to random intensity of 12 or more and a ratio of {554}<225> intensity to {111}<110> intensity of 7 or more in a texture of a center layer in the sheet thickness direction of the steel sheet subjected to primary recrystallization annealing.

3. The method of producing a grain oriented electrical steel sheet according to claim 1, wherein the steel slab further contains by mass % one or more elements selected from Ni: 0.005% to 1.5%, Sn: 0.005% to 0.50%, Sb: 0.005% to 0.50%, Cu: 0.005% to 1.5%, Cr: 0.005% to 0.10%, P: 0.005% to 0.50%, Mo: 0.005% to 0.50%, Ti: 0.001% to 0.1%, Nb: 0.001% to 0.1%, and V: 0.001% to 0.1%.

4. The method of producing a grain oriented electrical steel sheet according to claim 2, wherein the steel slab further contains by mass % one or more elements selected from Ni: 0.005% to 1.5%, Sn: 0.005% to 0.50%, Sb: 0.005% to 0.50%, Cu: 0.005% to 1.5%, Cr: 0.005% to 0.10%, and P: 0.005% to 0.50%, Mo: 0.005% to 0.50%, Ti: 0.001% to 0.1%, Nb: 0.001% to 0.1%, and V: 0.001% to 0.1%.

5. The method of producing a grain oriented electrical steel sheet according to claim 1, wherein an additional inhibitor treatment is performed at any stage between the primary recrystallization annealing and the secondary recrystallization annealing.

6. The method of producing a grain oriented electrical steel sheet according to claim 5, wherein nitriding treatment is performed, as the additional inhibitor treatment.

7. The method of producing a grain oriented electrical steel sheet according to claim 5, wherein one or more elements selected from sulfide, sulfate, selenide, and selenate are added to an annealing separator applied to the steel sheet before the secondary recystallization annealing, as the additional inhibitor treatment.

8. The method of producing a grain oriented electrical steel sheet according to claim 1, wherein a magnetic domain refining treatment is performed at any stage after the final cold rolling.

9. The method of producing a grain oriented electrical steel sheet according to claim 8, wherein the magnetic domain refining treatment is performed by applying electron beam irradiation to the steel sheet subjected to the secondary recrystallzation annealing.

10. The method of producing a grain oriented electrical steel sheet according to claim 8, wherein the magnetic domain refining treatment is performed by applying laser irradiation to the steel sheet subjected to the secondary recrystallization annealing.

* * * * *